United States Patent [19]

Novoselsky

[11] Patent Number: 4,733,432

[45] Date of Patent: Mar. 29, 1988

[54] POWER BRUSH, E.G. FOR VACUUM CLEANING APPARATUS

[76] Inventor: Boris Novoselsky, 66-01 110th St., Apt. 1B, Forest Hills, N.Y. 11375

[21] Appl. No.: 921,221

[22] Filed: Oct. 17, 1986

[51] Int. Cl.[4] ..... A47L 5/30

[52] U.S. Cl. ..... 15/340; 15/381; 15/385; 15/386

[58] Field of Search ..... 15/380, 381, 386, 385, 15/340

[56] References Cited

U.S. PATENT DOCUMENTS

| | | | |
|---|---|---|---|
| 1,506,016 | 8/1924 | Lundgren | 15/385 X |
| 3,436,788 | 4/1969 | Tamny | 15/385 X |
| 4,182,001 | 1/1980 | Krause | 15/385 X |

FOREIGN PATENT DOCUMENTS

| | | | |
|---|---|---|---|
| 576650 | 5/1933 | Fed. Rep. of Germany | 15/385 |
| 248612 | 5/1926 | Italy | 15/385 |
| 219092 | 5/1942 | Switzerland | 15/385 |

*Primary Examiner*—Chris K. Moore

*Attorney, Agent, or Firm*—Karl F. Ross; Herbert Dubno

[57] ABSTRACT

A power brush e.g. for a vacuum cleaner or street sweeper has its bristle bodies swivelably mounted on a member which is given an orbital movement so that the eccentric axes of the bristle bodies with respect to their swivel axis induces an additional oscillatory motion of each bristle body as it moves in the orbital path generated by the motion of the member on which its carrier is mounted.

15 Claims, 7 Drawing Figures

10
11
12
13
14
15
16
17
18
19
20
21
22
23
24
25
26
27
28
29
30
31
A
B

POWER BRUSH, E.G. FOR VACUUM CLEANING APPARATUS

CROSS REFERENCE TO RELATED APPLICATION

This application is related to Ser. No. 830,052 filed 13 Feb. 1986 as a continuation-in-part of my then pending application Ser. No. 720,260 filed 5 Apr. 1985 (now U.S. Pat. No. 4,596,113).

FIELD OF THE INVENTION

My present invention relates to a power brush and, more particularly, to a power brush for use in cleaning apparatus and especially in conjunction with a suction-generating source, e.g. for vacuum cleaners, street-cleaning equipment, and the like.

BACKGROUND OF THE INVENTION

It is common practice to provide a power brush for the treatment of a surface, e.g. to clean the latter or apply a particular texture thereto, for polishing or a similar purpose. An example of the use of such power brushes is in a vacuum cleaner for automatic or industrial purposes, or in a street-cleaning machine. However, power brushes are also used in floor washing operations independently of the application of suction.

In the past, the brushes employed have generally been of one of two types.

In one of these types, the bristles project radially from an elongated rotating support such as a shaft or drum and the brush is rotated about the axis with respect to which the bristles project radially. The brush is moved across the surface to be treated in a direction transverse to the axis and the brushing effectiveness is generally a function of the relationship between the downward force applied to the brush, the rate of rotation of the latter, the speed with which the brush is moved across the surface and, of course, the number and character of the bristles which project radially.

One of the drawbacks of this type of brushing action is that each bristle tends to meet the surface in the same way as each other bristle, i.e. each bristle is effectively rotated in its plane perpendicular to the axis and thus describes a circular pattern of movement, encountering the surface in the same direction upon each revolution.

In the other principal type of brush, a bristle carrier, e.g. a disk, is rotated about its axis and the bristles project from this disk generally in the axial direction with possible a convergence or a divergence to or from the axis. The bristles extend generally transversely to the surface, generally contact the latter at their tips, and are moved in a radial direction, the axis being upright.

Each bristle, therefore, sweeps the surface in a circular path and as the brush is moved over the surface, the circular paths of the multitude of bristles overlap and provide an effective brushing action. Notwithstanding the overlap of the circular pattern of movement of the bristles on each disk, however, as the bristles move through, for example, the nap of a carpet, they tend to displace the nap in the same direction so that ultimately the tufts of carpet are wiped in only one direction with each pass of the brush. This has drawbacks in carpet shampooing and, in general, this type of scrubbing action has been found to be less than satisfactory in many cases.

In my aforementioned copending application and the patent which has issued on its parent applicant, I have described a unique rake which can be used for soil cultivation and, indeed, for the preparation of the soil in place of plowing and like procedures, exploiting movable tines which automatically reposition themselves as a support for the tines is given an orbital or cyclical motion. This results in a unique pattern of movement of the tines with respect to the ground and has been found to break up more effectively than heretofore soil clumps, clods and the like.

I have now found that a similar pattern of movement can be utilized effectively in a power brush, especially in vacuum cleaner and like applications.

OBJECTS OF THE INVENTION

It is, therefore, the principal object of the present invention to provide an improved power brush, especially for vacuum cleaner and like applications which can overcome the above-mentioned drawbacks.

Another object of this invention is to provide a power brush with improved interaction between the surface to be treated and the bristles of the brush.

It is also an object of the invention to extend the principles of the above-mentioned application.

SUMMARY OF THE INVENTION

These objects and others which will become apparent hereinafter are attained, in accordance with the invention in a power-driven brush, comprising: a support displaceable in a travel direction over a surface adapted to be treated by the brush, at least one member mounted on the support for displacement in a cyclical pattern with at least a component of the displacement being transverse to the travel direction, a plurality of bristle carriers swivelably mounted on the member for pivotal movement about respective axes transverse to the surface, respective bodies of bristles affixed to the carriers and having an axis offset from the respective axis of pivotal movement of the respective carrier whereby the displacement of the member in the cyclical pattern causes the bodies to sweep the surface and induces each carrier to swivel relative to the member, and drive means on the support operatively connected to the member for cyclically displacing same relative to the support.

Advantageously, the support includes an enclosure within which the member is displaceable in the cyclical pattern, the brush further comprising suction-generating means connected with the enclosure for evacuating material loosened from the surface by the bristles from the enclosure.

Usually the brush will include a drive means in the form of an electric motor and means operatively connecting the electric motor with the movable member.

According to a feature of the invention, the member can be a bar pivotally connected at its ends with a pair of eccentrics respectively rotatable about respective upright axes.

A respective such bar and plurality of bristle carriers is provided symmetrically on opposite sides of a vertical, and the bars are driven symmetrically in opposite senses whereby reaction forces on the support resulting from the engagement of the bristles of the two bars with the surface are balanced.

The bar can form part of a frame comprising a plurality of such bars each having an array of the bristle carriers and respective bodies of bristles spaced apart in the travel direction.

The bristle bodies of one of the bars can be offset therealong to lie between the bristle bodies of another bar of the frame.

Each of the carriers can be formed with a shank, and a respective bearing surrounding the shank and pivotally mounting the respective carrier and its bristle body on the member.

The member can have respective sleeves each of which receives one of the bearings and the shank of a respective bristle carrier, and the shanks can be removably mounted in the respective sleeves.

Instead of bars the body of each member can be a disk in which the respective carrier can be swiveled and the enclosure can form part of a vehicle, e.g. for street cleaning and like sweeping purposes, or can have a handle affixed thereto for use as a domestic or industrial vacuum-cleaner brush.

An important advantage of the present invention is that, instead of being simply rotated about its axis, each bristle body has its axis offset from the axis about which its carrier can swivel, thereby permitting, as each carrier orbits yet another axis or in a cyclical pattern, the bristle bodies should oscillate from side to said as they are entrained along this orbital path, imparting a corresponding oscillatory action as the bristles course over the surface. The unique pattern of movement provides at any point in time a practically random scrubbing action between the bristles and the surface or any nap or tufts thereon and while the action is especially effective for surfaces requiring vigorous scrubbing, it is particularly advantageous for carpeting and the like.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2, 3:
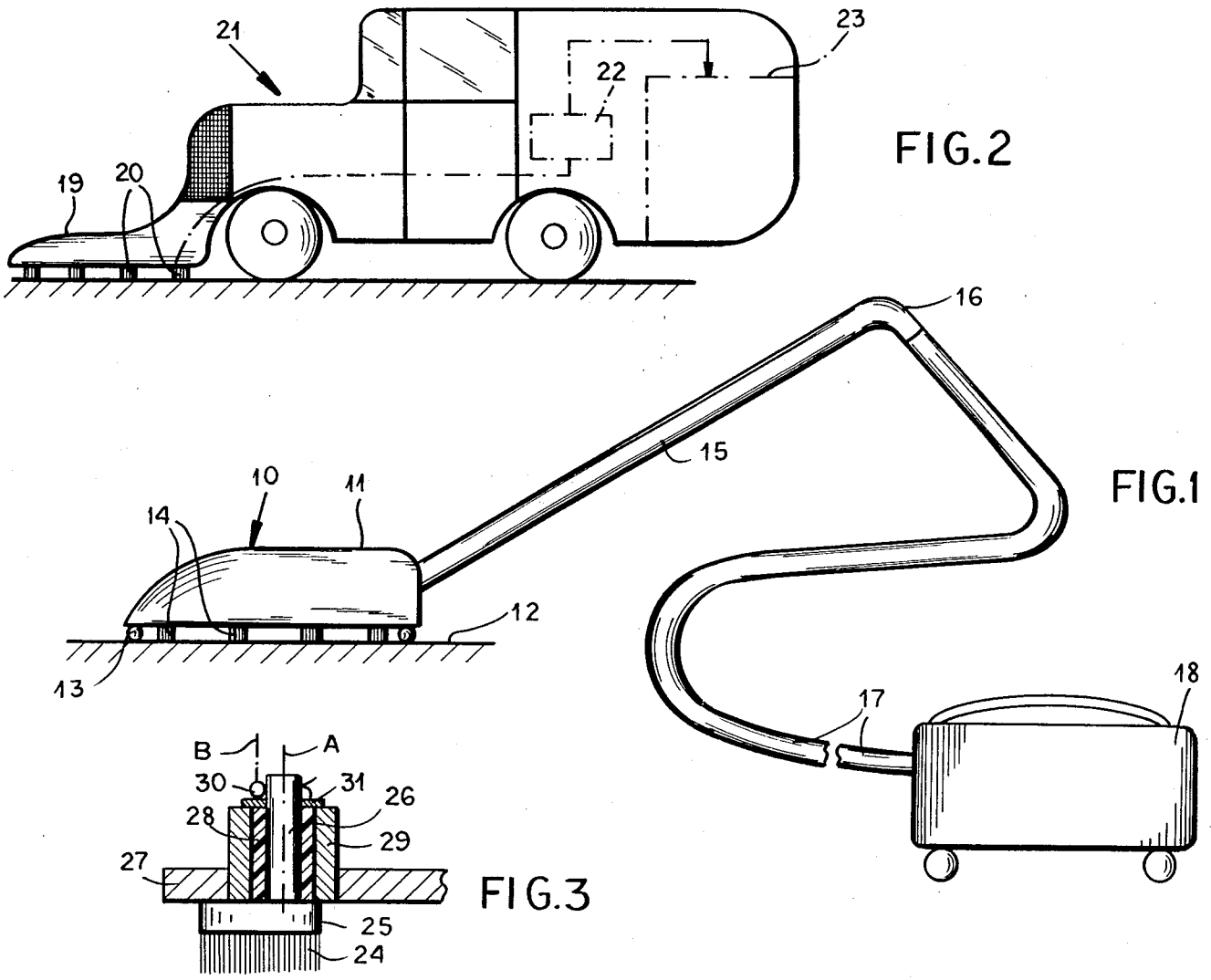
FIG. 1 is a side elevational view of a vacuum cleaner provided with a suction head whose power brush conforms to the present invention.
FIG. 2 is a side elevational view, in highly diagrammatic form, of a street sweeper utilizing the principles of this invention.
FIG. 3 is a cross sectional view through the mounting of a bristle carrier and one of the bristle bodies in an orbital member in accordance with the invention.

In FIG. 1 I have shown a suction head 10 for a vacuum cleaner which comprises an enclosure 11 adapted to ride along a surface 12, e.g. on rollers 13 while bristles of a plurality of bristle bodies engage this surface. The enclosure is connected by a tubular rigid shank 15 forming a handle 16 with a flexible vacuum cleaner hose 17 and to a canister-type suction-generating source 18 as is the case for a standard vacuum cleaner. As is conventional in the art, the electric motor in the head 10 can be driven by electrical energy supplied through conductors passing through the hose 17, the handle 16 and the pipe 15.

Alternatively, a suction head 19 with bristle bodies 20 can be provided on a street sweeper 21 shown as a vehicle and equipped with a suction source 22 discharging into a tank 23.

Spray nozzles (not shown) may discharge a scrubbing liquid onto the scrubbed region, the liquid being recirculated from the tank 23 from which soil has separated by sedimentation and filtration in the usual manner.

Each of the bristle bodies 14 or 20 may be mounted, as can be seen from FIG. 3 at 24, in a carrier 25, here shown to be a circular disk whose axis B coincides with the axis of the respective bristle body. The bristles may be composed of synthetics or natural bristle material, wire or the like, depending upon the specific application.

Each of the carriers 25 can have a shank 26 which swivelably mounts that carrier in an orbitally displaced member 27 via a bearing 28 shown as a nylon or polytetrafluoroethylene sleeve.

The sleeve 28 is, in turn, received in a metal sleeve 29 which can be fixed to the member 27 and the carrier 25, with its bristle body 24 can be removed and replaced in the case of wear or damage by extraction of a cotter pin 30 and removal of a washer 31.

Figure 6:
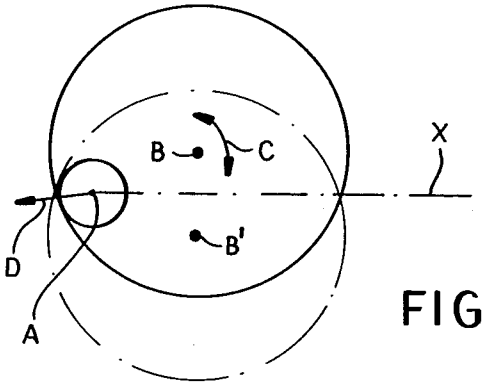
FIG. 6 is a diagram illustrating the pattern of movement mentioned previously.

Because the swivel axis A of the shank 26 is offset from the axis B of the bristle body and the carrier 25, as the axis A is moved in an orbital pattern as represented by the arrow D in FIG. 6, the axis B will oscillate from one side to another as represented by the arrow C of a median plane X, an alternative extreme position of the axis B being shown at B'.

As a result the arrow C represents an oscillation axis of the respective bristle body cast along the surface which is swept.

Each of the members upon which the carriers are swivelably mounted is provided with an array of such bristle bodies and carriers so that the interaction of the entire brush with the surface includes a random pattern engagement of the bristles with surface elements, in spite of the fact that the motion of the members is cyclical.

Figure 4:
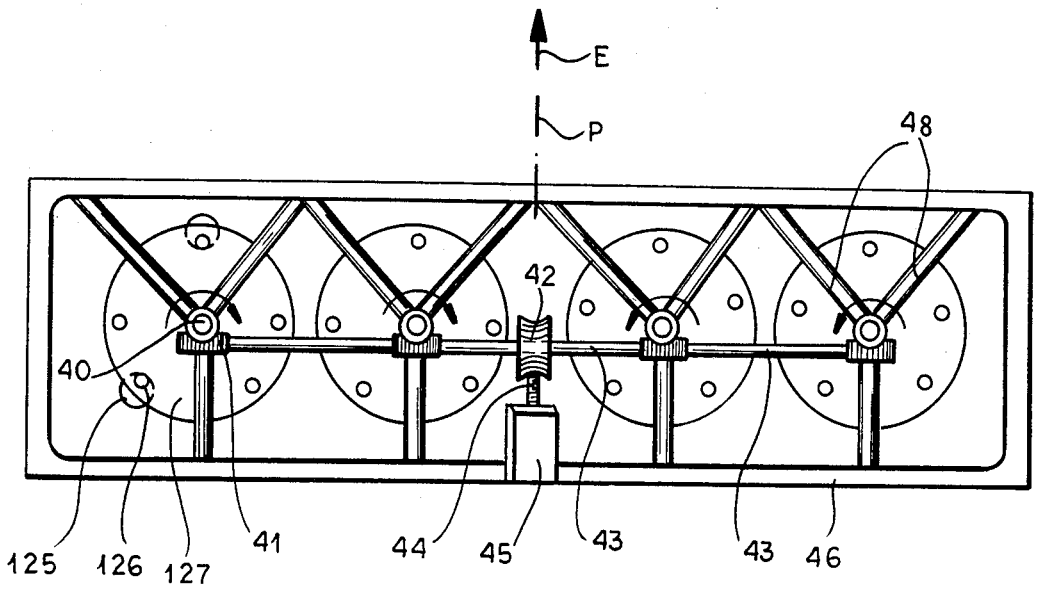
FIG. 4 is a plan view of an array of members extending transversely to a travel direction for a vacuum cleaner head or a street sweeper head in accordance with the invention.
Figure 7:
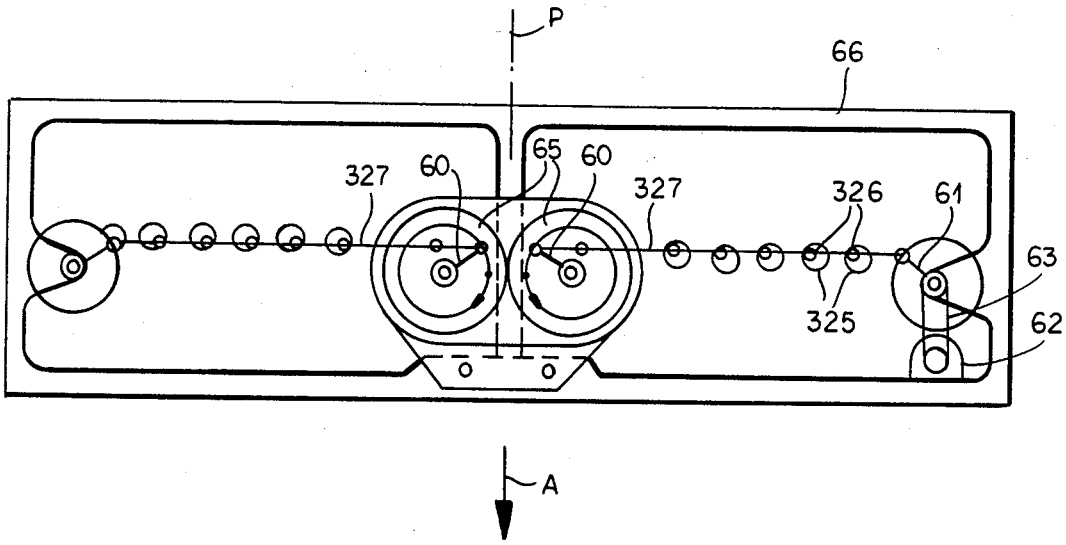
FIG. 7 is another plan view of the support and another system for causing the orbital action of the members of the invention.

In FIG. 4, for example, the members are shown at 127 to be disks upon which the carriers 125 are swivelable about their respective shanks 126, as the disks themselves are rotated, e.g. by a worm gear 40 and a worm 41 driven by a worm gear 42 connected to the common shaft 43 of the worms 41. The swivel action results from the fact that the bristles engage the swept surface irregularly. The worm gear 42 is, in turn, driven by a worm 44 from an electric motor 45 mounted on a support frame 46 within the enclosure 11 or 19 and supporting the disks 127 via spiders 48.

The worms are so pitched that on opposite sides of a vertical median plane P extending in the direction of displacement of the brush, represented by the arrow E, the motion of the members 127 is mirror-symmetrical so that the disks on one side of this plane are rotated in the clockwise sense while the disks on the opposite sides are rotated in the counterclockwise sense, thereby balancing the reaction forces on the head and allowing the head to be displaced without deflection as a result of these reaction forces.

Figure 5:
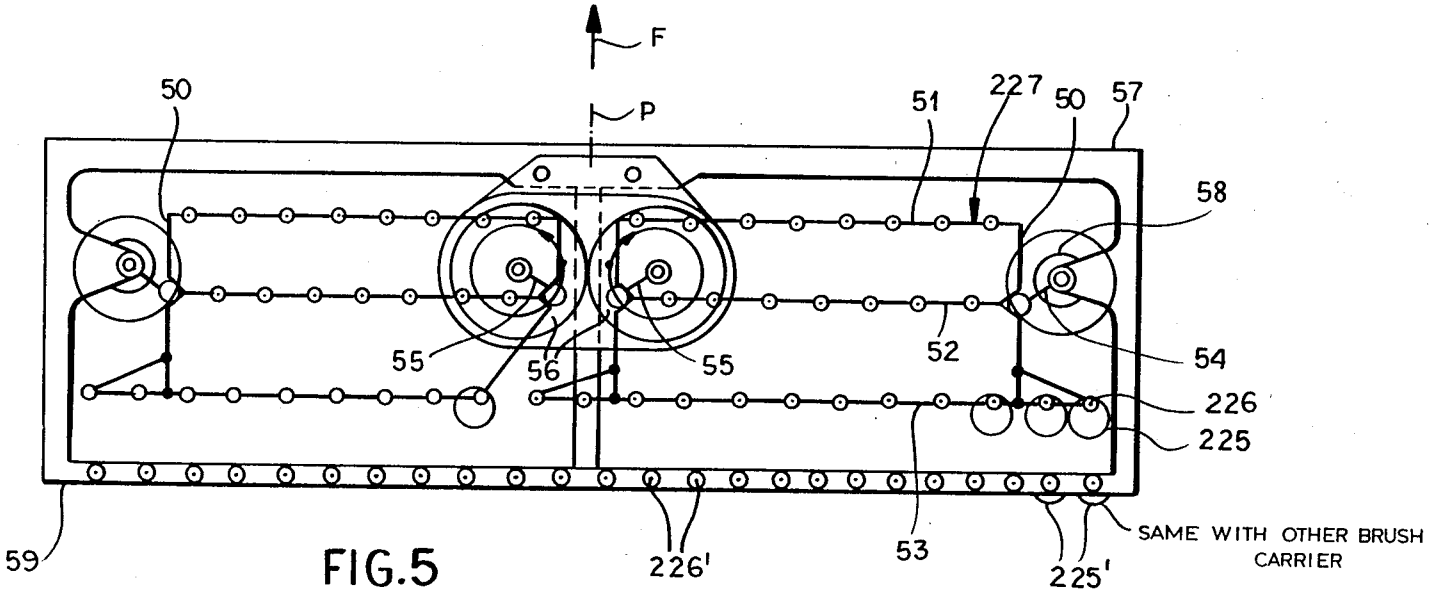
FIG. 5 is a view similar to FIG. 4 illustrating another embodiment.

In FIG. 5, I have shown another embodiment wherein the members 227 on which the carriers 225 are swivelable, are bars of a frame 50. The bars 51, 52 and 53 have the respective arrays of bristle bodies so offset that the bristle bodies on one bar lie intermediate of the bristle bodies of another bar in the direction F of displacement of this head.

Each of the frames 50, of which two are disposed to move symmetrically in opposite senses with respect to the median plane P, is mounted on a pair of cranks 54, 55, the cranks 55 being connected to gear wheels 56 which mesh to ensure synchronous orbital displacement of the frames and hence of the carriers 225 swivelably connected thereto by their shanks 226. Each of the carriers 225, like the carriers 125, is provided with a respective bristle body as shown at 24 in FIG. 3.

The support for the two orbital frames is represented at 57 in FIG. 5 and one of the cranks 54 is shown to be directly driven by an electric motor 58. The frame 57 may have nonorbital members 59 likewise provided with bristle bodies 225' swivelable about the respective shanks 226' with the same effect as that already described.

Single arrays of such bristle bodies are provided on the carriers 325 with their shanks 326 on a pair of members 327 carried by cranks 60 and 61 at least one of which is driven by an electric motor 62. In the latter case, the drive utilizes a belt transmission 63. The cranks 60 are connected to meshing gear wheels 65 to ensure synchronous but offset orbital displacement of the two members in the support 66 which, like the support 57, can be mounted in the vacuum cleaner head of FIG. 1 or the street sweeper head of FIG. 2.

In all of the embodiments described, the orbital movement of the members gives rise not only to a corresponding sweeping motion of the respective bristle body, but also to an oscillatory motion of the bristle body as has been described in connection with FIG. 6, thereby greatly enhancing the cleaning action.

I claim:

1. A power-driven brush, comprising:

a support displaceable in a travel direction over a surface adapted to be treated by the brush;

at least one member mounted on said support for displacement in a cyclical pattern with at least a component of said displacement being transverse to said travel direction;

a plurality of bristle carriers swivelably mounted on said member for pivotal movement about respective axes transverse to said surface;

respective bodies of bristles affixed to said carriers and each having an axis offset from the respective axis of pivotal movement of the respective carrier whereby the displacement of said member in said cyclical pattern causes said bodies to sweep said surface and induces each carrier to swivel relative to said member; and drive means on said support operatively connected to said member for cyclically displacing the same relative to said support.

2. The power-driven brush defined in claim 1 wherein said support includes an enclosure within which said member is displaceable in said cyclical pattern, said brush further comprising suction-generating means connected with said enclosure for evacuating material loosened from said surface by said bristles from said enclosure.

3. The power-driven brush defined in claim 2, further comprising handle means connected with said enclosure for displacing the same manually across said surface.

4. The power-driven brush defined in claim 2, further comprising a vehicle supporting said enclosure for displacing the same across said surface.

5. The power-driven brush defined in claim 4 wherein said vehicle is a self-propelled vehicle equipped with said suction-generating means.

6. The power-driven brush defined in claim 1 wherein said drive means includes an electric motor and means operatively connecting said electric motor with said member.

7. A power-driven brush, comprising:

a support displaceable in a travel direction over a surface adapted to be treated by the brush;

at least one member mounted on said support for displacement in a cyclical pattern with at least a component of said displacement being transverse to said travel direction;

a plurality of bristle carriers swivelably mounted on said member for pivotal movement about respective axes transverse to said surface;

respective bodies of bristles affixed to said carriers and having an axis offset from the respective axes of pivotal movement of the respective carrier whereby the displacement of said member in said cyclical pattern causes said bodies to sweep said surface and induces each carrier to swivel relative to said member; and drive means on said support operatively connected to said member for cyclically displacing same relative to said support, said member being a bar pivotally connected at its ends with a pair of eccentrics respectively rotatable about respective upright axes.

8. The power-driven brush defined in claim 7 wherein a respective such bar and plurality of bristle carriers is provided symmetrically on opposite sides of a vertical, and said bars are driven symmetrically in opposite senses whereby reaction forces on said support resulting from the engagement of the bristles of the two bars with the surface are balanced.

9. The power-driven brush defined in claim 7 wherein said bar forms part of a frame comprising a plurality of such bars each having an array of said bristle carriers and respective bodies of bristles spaced apart in said travel direction.

10. The power-driven brush defined in claim 9 wherein the bristle bodies of one of said bars are offset therealong to lie between the bristle bodies of another bar of said frame.

11. The power-driven brush defined in claim 1 wherein each of said carriers is formed with a shank, and a respective bearing surrounding said shank and pivotally mounting the respective carrier and its bristle body on said member.

12. The power-driven brush defined in claim 11 wherein said member is formed with a respective sleeve receiving each of said bearings.

13. The power-driven brush defined in claim 12, further comprising means for removably mounting each of said shanks in a respective one of said sleeves.

14. The power-driven brush defined in claim 1 wherein said member is a disk rotatable on said support.

15. The power-driven brush defined in claim 14 wherein a plurality of such disks are mounted on said support and are spaced apart transversely to said travel direction.

* * * * *